US005829360A

United States Patent [19]

Rench et al.

[11] Patent Number: 5,829,360

[45] Date of Patent: Nov. 3, 1998

[54] AUTO RACK DOOR LOCK

[75] Inventors: Michael J. Rench, Wyandotte, Mich.; Eric M. Wrobley, Athens, Ga.

[73] Assignee: Thrall Car Manufacturing Company, Chicago Heights, Ill.

[21] Appl. No.: 831,550

[22] Filed: Apr. 9, 1997

[51] Int. Cl.[6] ..... E05B 65/14

[52] U.S. Cl. ..... 105/355; 105/378; 292/33; 292/40; 296/146.8

[58] Field of Search ..... 105/355, 378, 105/395; 292/33, 40, 164, 173; 296/146.8, 146.9, 146.13; 70/100, 106

[56] References Cited

U.S. PATENT DOCUMENTS

| | | | |
|---|---|---|---|
| 3,911,831 | 10/1975 | Blunden | 105/378 |
| 3,995,563 | 12/1976 | Blunden | 105/378 |
| 3,996,860 | 12/1976 | Ravani et al. | 105/368 |
| 4,077,330 | 3/1978 | Peisner et al. | 105/410 |
| 4,084,516 | 4/1978 | Ravani et al. | 105/368 |
| 4,265,183 | 5/1981 | Peisner et al. | 105/410 |
| 4,324,189 | 4/1982 | Roldness | 105/378 |
| 4,437,410 | 3/1984 | Stoller, Sr. et al. | 105/378 |
| 4,936,227 | 6/1990 | Baker et al. | 105/378 |
| 5,029,909 | 7/1991 | Bunger | 292/40 |
| 5,255,952 | 10/1993 | Ehrlich | 296/146.13 |

*Primary Examiner*—S. Joseph Morano
*Attorney, Agent, or Firm*—Fitch, Even, Tabin & Flannery

[57] ABSTRACT

An auto rack car has an improved door locking mechanism for heightened security in auto rack car doors which rely on upper and lower lock assemblies for security. The improved locking mechanism is lightweight and inexpensive and is adaptable for retrofit installation to lock assemblies which are currently in use on auto rack cars. The locking mechanism thus provides a commercially viable means to prevent unauthorized intrusions into the car involving unlocking of an upper lock assembly and subsequent flexure of the door while a lower lock assembly remains locked.

14 Claims, 3 Drawing Sheets

46
32
42
33
16
34
40
36
38
44
48
10
50
28
12
62
48
68
2
2
52
70
68
18
20
30
21
14
66
29
22
24
26
℄ CAR

AUTO RACK DOOR LOCK

The present invention generally relates to a railway auto rack car for transporting automobiles. More specifically, the invention relates to an enclosed auto rack car having an end closure provided by a pair of doors and a lock assembly for those doors.

BACKGROUND OF THE INVENTION

Auto rack cars typically have an end closure comprising a pair of end doors to protect the contents of the car from flying objects, as well as to limit unauthorized entry into the car. To prevent or reduce vandalism, theft and improper use of auto rack cars for transportation, there is a continuing need for improved security arrangements to prevent unauthorized entry into auto rack cars. U.S. Pat. Nos. 3,995,563 and 4,936,227 disclose an end closure having end doors comprising vertical panels which extend across the end of the rail car when in a closed position and which travel along a track into an open position for loading and unloading.

Because of the height of multilevel auto rack cars and because the doors generally are of a relatively light weight, flexure of the doors along their lengths may occur. To control such flexure, as disclosed in the '227 patent, a lock assembly for a bi-level auto rack car may comprise an upper and a lower door lock mounted on the interior side of each door. The lower door lock is mounted at the lower deck of the rail car, and the upper door lock is mounted at a height equivalent to the level of the upper deck.

Each door lock includes a lever and pin configuration. The lever is pivoted intermediate from its ends to a plate on the door and pivotally connected at one end to a pin. The pin locks the door into position by engaging a lock receiver mounted on the deck opposite the door lock. The lowermost door lock is fitted with a key assembly. This key assembly comprises a square bore, which receives a key of the same shape, at the center of rotation of the lever. This bore is accessible from the exterior side of the door. Manual rotation of the key when inserted into the bore causes the lever to rotate so that the pin-connected end rotates upward and the pin disengages the lock receiver, thereby unlocking the door lock.

A cable attached to each lever at the end opposite the pin connects the levers. As the key is turned in the lowermost door lock, the cable-connected end of the lever rotates downward and the cable translates the rotational motion of the lower door lock to the upper door lock, as well. Thus, both the upper and lower door locks can be unlocked simultaneously using a single key.

Additional security is provided by a hasp which is connected to both end doors to hold them together in closed position. The hasp may be held in place by a steel cable or rod which must be cut to permit the doors to open. Alternatively, the hasp may be held in place by a padlock or other means for locking it in position.

Notwithstanding the locking arrangement described above, unauthorized intrusions are still thought to occur. It is believed that it is possible for a person to reach in from outside the car and grasp the cable connecting the two levers. A pull on the cable may cause the lever of the upper door lock to rotate, thereby unlocking that lock as described above. With the upper door lock unlocked, it is thought that individuals can then flex the upper portions of the doors enough to enter the rail car.

There remains a need for a means to improve security for preventing unauthorized entry into auto rack cars.

SUMMARY OF THE INVENTION

In accordance with the present invention there is provided an auto rack car with an improved door locking mechanism for heightened security in auto rack car doors which rely on upper and lower lock assemblies for security. The improved locking mechanism preferably is lightweight and inexpensive and is adaptable for retrofit installation to lock assemblies as described above which are currently in use on auto rack cars. The locking mechanism thus provides a commercially viable means to prevent unauthorized intrusions into the car involving unlocking of an upper lock assembly and subsequent flexure of the door while a lower lock assembly remains locked.

In the preferred embodiment, the improved locking mechanism comprises a security lock to prevent the unlocking of the upper door lock without first unlocking the hasp. The security lock is mounted on the door and may be connected by, for example, a cable to the lever of the upper door lock. The cable may pass from the security lock up through a pulley located above the upper door lock and then down to the lever of the upper door lock. When locked, the security lock and cable constrain the upper door lock lever such that it is not possible to rotate the lever enough to disengage the pin from the lock receiver.

In the preferred embodiment, the security lock comprises a movable member, which is slidably mounted on the interior of the door at the edge adjacent to the other door and which engages the hasp which extends across the space between the two doors on the exterior of the doors when in its locked position. The movable member may include a finger that extends outward between the two doors past the exterior surface of the doors immediately below the hasp, so that the hasp limits upward motion of the movable member when locked, which in turn limits downward rotational movement by the cable-connected end of the lever of the upper door lock to prevent unauthorized unlocking of the upper door lock.

DETAILED DESCRIPTION OF THE PREFERRED EMBODIMENT

Figure 1:
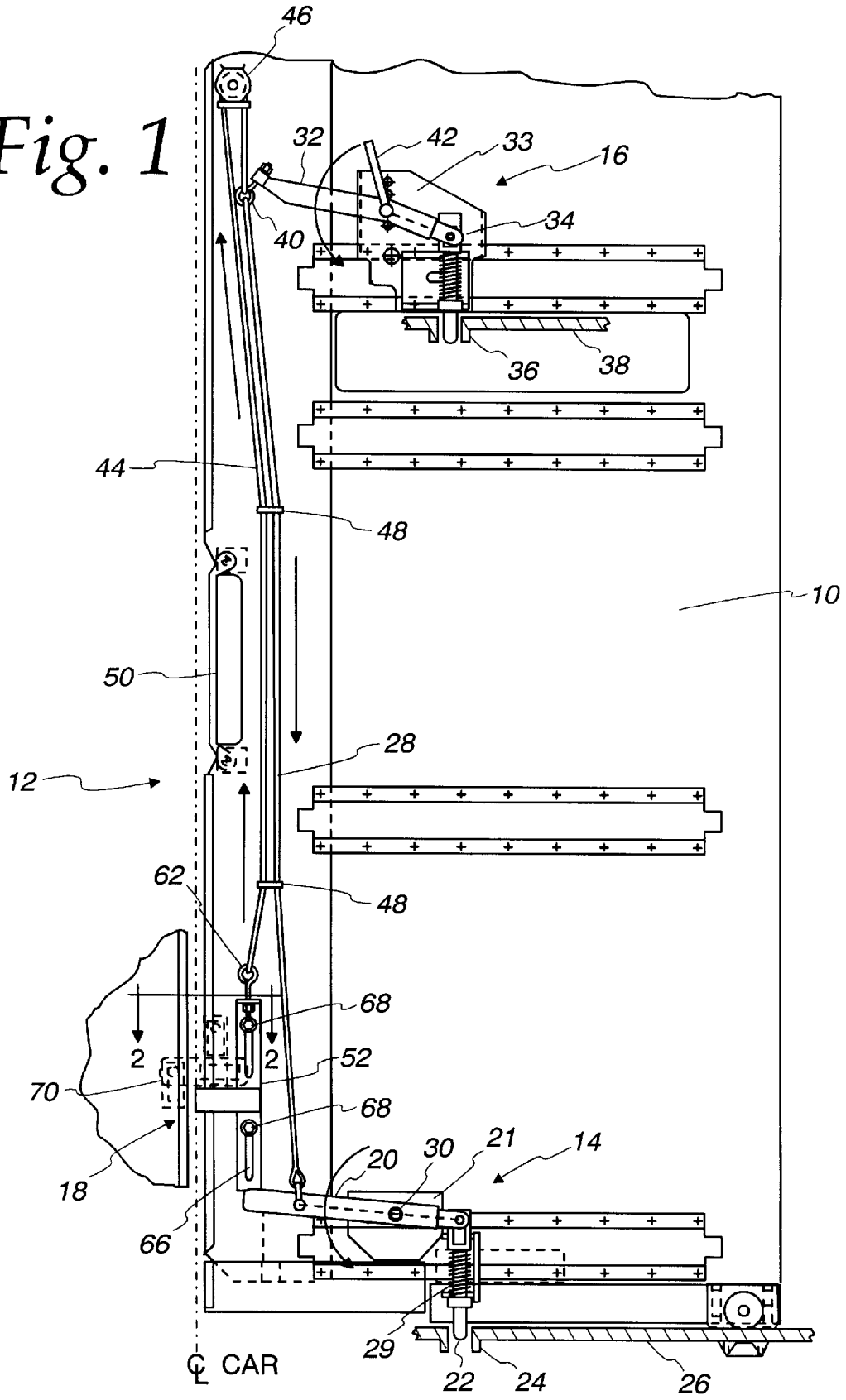
FIG. 1 is an elevational view of a door locking mechanism from the interior of the rail car.

The present invention generally is embodied in a multilevel auto rack car having at least one end closure with a locking mechanism to secure the end closure. In the preferred embodiment, the end closure comprises two doors, which comprise vertical panels mounted for travel along a track. Referring to FIG. 1, a door 10 of a bi-level auto rack car includes a locking mechanism 12 comprising a lower door lock 14 and an upper door lock 16 both mounted on the interior of the door 10, as well as a security lock 18 mounted on the door 10. Each door 10 of the auto rack car includes such a locking mechanism 12, however, FIG. 1 shows only the locking mechanism of one door. Although FIG. 1 shows the locking mechanism for a bi-level auto rack car, similar locking mechanisms can be used on bi-level cars having alternate configurations and on tri-level auto rack cars.

The lower door lock 14 has a lever 20 which is pivoted intermediate from its ends to a plate 21 on the door 10. The lever 20 is pivotally connected to a vertically-oriented pin 22 at one end. When the door 10 is in a closed position, the pin 22 engages a lock receiver 24. The lock receiver 24 may be mounted on a bottom track 26 along which the door 10 rolls or otherwise affixed to the car body or floor. The lock receiver 24 may comprise a short length of pipe oriented vertically to receive the pin 22. The other end of the lever 20 has a cable 28 connected to it at a position near to or at the end of the lever 20. Any connecting means, such as a bar, wire, chain, rope or cord, can be used in place of the cable 28. The lock 14 is biased toward a locked position in which the pin-connected end of the lever 20 is lower relative to the cable-connected end and in which the pin 22 is engaged by the lock receiver 24. To this end, the pin is positioned to pan through a coil spring 29 loaded in compression and having its lower end acting against a washer on the pin 22 near its lower end.

A bore 30 through the pivot point of the lever 20 is accessible from outside the car. The bore 30 is shaped to accommodate a key which can be inserted into the bore 30 in order to manually unlock the door lock 14. Typically, the bore 30 is square-shaped and a key of the same shape is used to unlock the door lock 14. When a person outside of the car inserts the key into the bore 30 and rotates the key in a clockwise direction, the lever 20 inside of the car rotates, causing the pin-connected end to rotate upward such that the pin 22 is disengaged from the lock receiver 24. Additionally, the cable-connected end rotates downward, pulling the cable 28 downward.

The upper door lock 16 is similar to the lower door lock 14, however, a primary difference is that the upper door lock 16 need not be fitted with a bore 30 and unlocked by a key. Similar to the lower door lock 14, the upper door lock 16 has a lever 32 which is pivoted intermediate from its ends to a plate 33 on the door 10. The plate 33 has a vertical series of holes therein to enable the pivot point to be changed to adjust cable tension and/or to accommodate strain elongation of the cable 28. One end of the lever 32 is pivotally connected to a pin 34, and when the door 10 is in a closed position, the pin 34 engages a lock receiver 36. This lock receiver 36 is mounted to the deck 38 opposite the upper door lock 16. The lever 32 is biased toward a locked position in which the pin-connected end is lower relative to the cable-connected end.

The other end of the lever 32 is connected to the same cable 28 that is connected to the lower lever 20. When the lower lever 20 is rotated into an unlocked position, the downward rotation of the cable-connected end of the lower lever 20 results in a downward rotation of the cable-connected end of the upper lever 32, as the cable 28 is pulled down by the rotation of the lower lever 20. Thus, both locks 14 and 16 can be unlocked simultaneously by manually unlocking only the lower door lock 14, which is easily accessible to an individual standing on the ground. Such a feature is desirable because it is difficult, if not impossible, for an individual to reach the upper door lock 16 without the use of a ladder or other means of reaching up to the height of the upper door lock 16.

The upper lever 32 can be constructed somewhat differently from the lower lever 20. An eye bolt 40, or other ring-like member, extends from the end of the lever 32 to which the cable 28 is connected. A second lever 42 extends from the pivot point and is used to manipulate the lever 32 and/or pivot pin when adjusting the position of the pivot pin of the lever 32 on the plate 33 in order to maintain the desired amount of tension in the cable 28 connecting the two levers 20 and 32.

A second cable 44 connects the lever 32 of the upper door lock 16 to the security lock 18. Any flexible connecting means, such as a wire, chain, rope or cord, can be used in place of the cable 44. This cable 44 also is connected to the eye bolt 40 by which the first cable 28 is connected to the upper lever 32. From the eye bolt 40 on the lever 32, the cable 44 travels up to a pulley 46 mounted somewhere above the upper door lock 16, through the pulley 46 and down to the security lock 18, which is mounted to the door 10 at an elevation below the upper door lock 16 but still accessible to an individual standing on the ground. The two cables 28 and 44 may pass through guides 48 to remove them from the open area around the door handle 50 and to secure them against the door 10.

Figure 6:
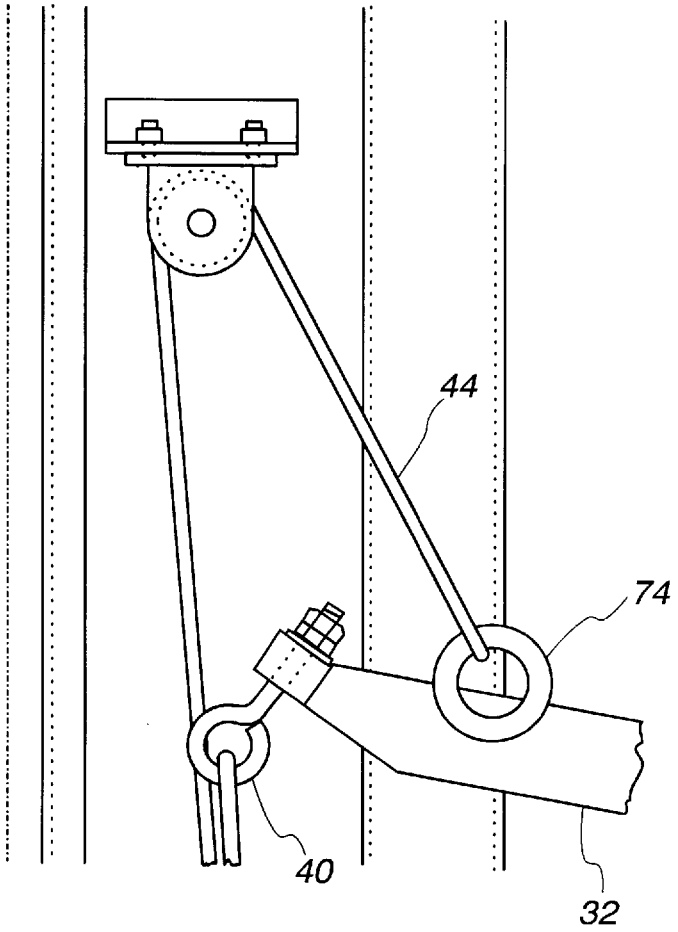
FIG. 6 is an elevational view of an alternate embodiment of the cable attachments to the upper door lock.

In an alternate embodiment, as shown in FIG. 6, the cable 44 is not connected to the upper lever 32 by the eye bolt 40. A washer 74 or other member is welded or otherwise attached to or formed on the upper lever 32 at a point on the upper lever 32 inward from the end of the upper lever 32 and the eye bolt 40. The cable 44 is connected to the upper lever 32 by the washer 74.

The security lock 18 comprises a movable member 52 mounted along the edge 11 of the door 10 adjacent to the other door. Also referring now to FIG. 2 through FIG. 5, the T-shaped movable member 52 has a first part 54 and a second part 56. The first part 54 is L-shaped with the shorter side 58 located at the top and extending away from the door 10. The shorter side 58 has a hole 60 through which an eye bolt 62 is connected. The cable 44 is attached to this eye bolt 62 and extends vertically upward from the first part 54 of the movable member 52. The longer side 64 is vertically aligned along the edge of the door 10 and has two or more slots 66 along its length by which the movable member 52 is slidably mounted to the door 10. Bolts 68 or other fastening members are used to mount the movable member 52, as well as to provide a nonmovable means about which the slots 66 slide up and down. The movable member 52 is gravity-driven, and the top of the slots 66 rest on the bolts 68 in a lower, locked position. When the door locks 14 and 16 are unlocked, however, the slots 66 allow the movable member 52 to slide upward into its unlocked position as the cable 44 is pulled through the pulley 46 by the downward motion of the levers 20 and 32, thereby allowing the levers 20 and 32 to rotate sufficiently to allow the pins 22 and 34 to disengage the respective lock receivers 24 and 36.

The second part 56 of the movable member 52 is welded to the longer side 64 of the first part 54 at some distance between the slots 66 and preferably at the midpoint of the longer side 64 to provide stability. The second part 56 extends horizontally along the door 10 away from the first part 54 and toward the space between the pair of doors 10. The second part 56 is comprised of four integral segments and is shaped to fit around the edge 11 of the door 10. The first segment 57 is generally straight and is welded across the longer side 64 of the first part 54. As the first segment 57 extends horizontally beyond the longer side 64 and toward the edge 11 of the door 10, it angles away from the door into the second segment 59. The second segment 59 extends at about a 45° angle away from the door 10 and then angles into the third segment 61, which is approximately parallel to the first segment 57 but farther from the door 10. The third segment 61 curves into the fourth segment 63, which is essentially perpendicular to the first segment 57, the third segment 61 and the door 10. This fourth segment 63 extends between the edges 11 of the two doors 10 and projects past the exterior of the door 10.

The security lock 18 also comprises a hasp 70 mounted to the exterior of the doors 10. The hasp has a first connecting member 71 mounted near the edge 11 of one door 10 and a second connecting member 73 mounted near the edge 11 of the opposite door 10, such that the hasp 70 spans across the space between the pair of doors 10. The hasp 70 has a movable arm 72 movably connected to the first connecting member 71. The arm 72 rotates between a locked position in which the arm 72 extends across the space between the doors 10 and engages the second connecting member 73, thereby holding the doors 10 together, and an open position in which the doors 10 can move independently. A pin, padlock or other locking means can be inserted through the second connecting member 73 to secure the arm 72 in a locked position.

The security lock 18 is positioned so that when the arm 72 is in the locked position, it extends between the doors 10 above the second part 56 of the movable member 52. That section of the second part 56 which projects past the exterior surface of the doors 10 will engage the arm 72 of the hasp 70 if the movable member 52 is pulled upward. As a result, movement of the movable member 52 in the upward direction is limited by the hasp 70 when the hasp 70 is in a locked position, and consequently, downward movement of the lever 32 of the upper door lock 16 also is limited, because of the upward force created by the cable 44 connecting the movable member 52 and the upper door lock 16. Thus, maintaining the hasp 70 in a locked position will prevent the pin 34 of the upper door lock 16 from disengaging the lock receiver 36.

Figure 2:
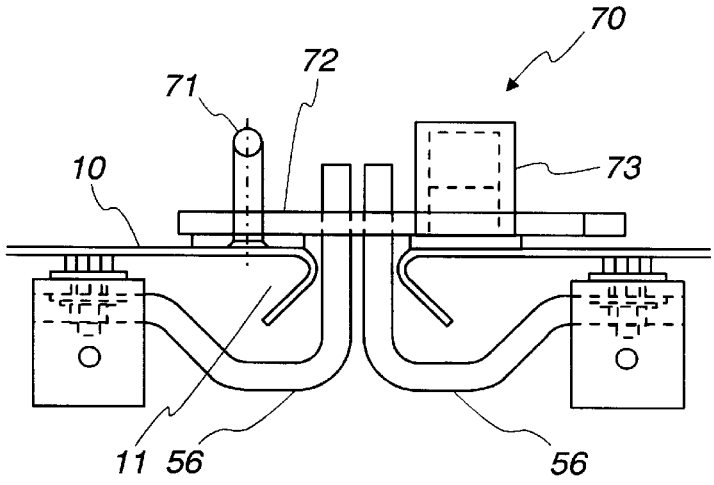
FIG. 2 is a cross-sectional view showing the hasp and the security lock mounted on the rail car doors.
Figure 3:
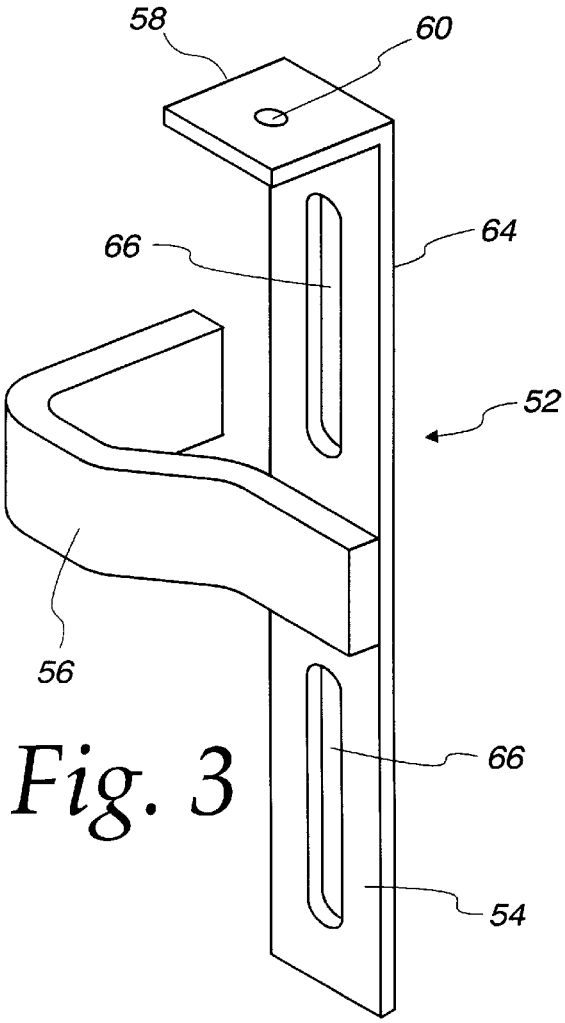
FIG. 3 is a perspective view of the security lock.
Figure 4:
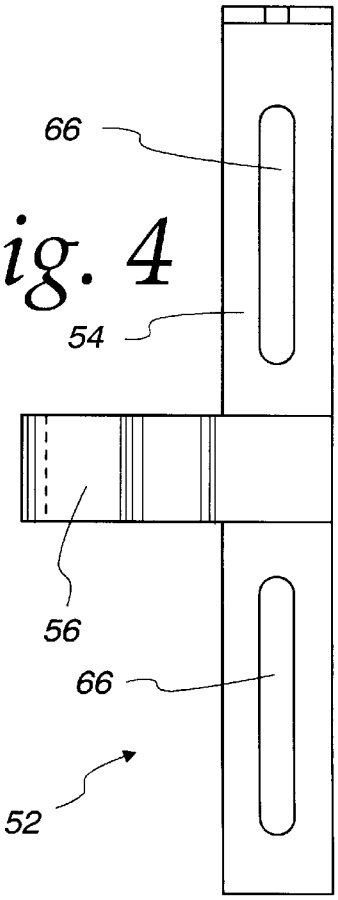
FIG. 4 is an elevational view of the security lock.
Figure 5:
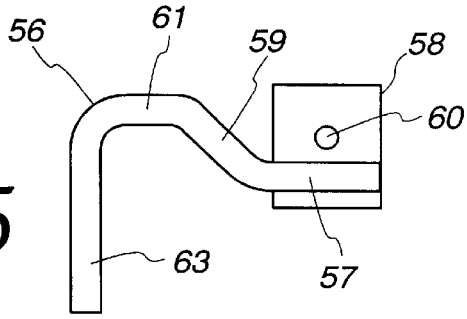
FIG. 5 is a bottom view of the security lock.

Each door 10 of the auto rack car is fitted with door locks 14 and 16 and a security lock 18 mounted on the interior of the door 10 at the side closest to the space between the pair of doors. As each security lock 18 has a second part 56 that projects between the pair of doors as can be seen in FIG. 2, the hasp 70 serves to limit movement of both security locks 18 by preventing movement in an upward direction as described previously. Although the locking mechanism for a bi-level auto rack car has been described, it also is possible to utilize such a combination of door locks 14 and 16, security locks 18 and hasp 70 on a tri-level auto rack car.

Numerous modifications to the locking mechanism may be possible to further improve security. Thus, modifications and variations in practice of the invention are expected to occur to those skilled in the art upon consideration of the foregoing detailed description of the invention. Although a preferred embodiment has been described above and illustrated in the accompanying drawings, there is no intent to limit the scope of the invention to this or any other particular embodiment. Consequently, any such modifications and variations are intended to be included within the scope of the following claims. The invention is described further and pointed out by the following claims.

What is claimed is:

1. A multilevel auto rack car comprising at least one pair of end doors, each of said doors comprising:

an elongated, vertically oriented panel;

a lower door lock assembly comprising a lever for shifting the door lock assembly from a locked position to an unlocked position;

an upper door lock assembly comprising a lever for shifting the door lock assembly from a locked position to an unlocked position;

a connecting member to connect said lever of said upper door lock assembly with said lever of said lower door lock assembly;

said door being somewhat flexible such that an upper portion of the door may be flexed outward when only the lower door lock assembly is in locked position; and an auxiliary security mechanism which prevents unauthorized persons from gaining entry to the auto rack car by unlocking the upper door lock assembly and subsequently flexing an upper portion of the door, said auxiliary security mechanism comprising a locking mechanism connected to said lever of said upper door lock assembly to selectively prevent movement of said lever of said upper door lock assembly, said locking mechanism being operable from a location beneath said upper door lock assembly.

2. A multilevel auto rack car in accordance with claim 1, wherein said locking mechanism comprises a movable member comprising a first part movably mounted on the interior surface of one door and a second part extending from said first part between said pair of doors.

3. A multilevel auto rack car in accordance with claim 2, wherein said movable member is T-shaped and wherein said first part is vertically aligned and said second part extends horizontally from said first part.

4. A multilevel auto rack car in accordance with claim 3, wherein said movable member has two or more slots extending vertically along the length of said first part, each having a top end and bottom end, with said second part being between two of said slots, said movable member being slidably mounted by one or more bolts inserted through said slots, and wherein said movable member is movable between an upper, unlocked position and a lower, locked position and is gravity driven to reliably return to said lower position, said top ends of said slots resting on said bolts when said movable member is in said lower, locked position.

5. A multilevel auto rack car in accordance with claim 2, wherein said locking mechanism further comprises a hasp mounted on the exterior surface of said door and having an arm movable between a first position and a second position, said arm extending across the space between the doors above said second part of said locking mechanism when said arm is in said first position, such that said hasp limits movement of said locking mechanism in an upward direction when said arm is in said first position.

6. A multilevel auto rack car in accordance with claim 2, wherein said second part is curved to fit along the surface of said door as said second part extends horizontally from said first part and projects beyond the exterior surface of said door between said pair of doors.

7. A multilevel auto rack car in accordance with claim 1, further comprising a pulley and flexible connecting member having a first and second end, wherein said flexible connecting member is connected at said first end to said locking mechanism and at said second end to said lever of said upper door lock assembly and, in between the ends, said flexible connecting member extends through said pulley located above said upper door lock assembly.

8. A multilevel auto rack car in accordance with claim 7, wherein said flexible connecting member is selected from the group consisting of a wire, a cable, a chain, a rope and a cord.

9. A multilevel auto rack car comprising:

at least one pair of doors;

upper and lower door lock assemblies each comprising a lever having a pivot point, a pin and a lock receiver and wherein said lever pivots about said pivot point to cause said pin to disengage from said lock receiver;

a connecting member to connect said lever of said upper door lock assembly with said lever of said lower door lock assembly;

a security lock comprising a movable member comprising a first part slidably mounted to the door and a second part that extends between said doors and a hasp movable between a first position and a second position, said hasp extending above said second part when said hasp is in said first position, wherein said hasp limits movement of said security lock; and a cable and pulley assembly to connect said movable member to said lever of said upper door lock assembly, wherein said cable and pulley assembly limits movement of said lever when said hasp of said security lock is in said first position.

10. A multilevel auto rack car in accordance with claim 9, wherein said movable member is T-shaped and wherein said first part is vertically aligned and said second part extends horizontally from said first part.

11. A multilevel auto rack car in accordance with claim 9, wherein said lower door lock assembly further comprises a bore at said pivot point and a key shaped to fit said bore, wherein said key can be manually inserted into said bore and rotated, causing said lever to rotate and said pin to disengage from said lock receiver and causing said connecting member to initiate rotation of said upper door lock assembly such that said pin of said upper door lock assembly also disengages from said lock receiver.

12. A multilevel auto rack car in accordance with claim 11, wherein said cable and pulley assembly selectively constrains said lever of said upper door lock assembly to selectively limit rotation of said lever and prevent said pin from disengaging said lock receiver.

13. A multilevel auto rack car in accordance with claim 9, wherein said connecting member is selected from the group consisting of a wire, a cable, a chain, a rope and a cord.

14. A multilevel auto rack car comprising a pair of end doors, each of said end doors having an upper end and a lower end and comprising:

an elongated, vertically oriented panel;

an upper door lock assembly movable between a locked position and an unlocked position;

a lower door lock assembly movable between a locked position an unlocked position;

a connecting member to connect said upper door lock assembly to said lower door lock assembly such that movement of the lower door lock assembly from locked position to unlocked position effects movement of said upper door lock assembly from said locked position to said unlocked position;

said door being somewhat flexible such that an upper portion of the door may potentially be flexed outward enough to permit an individual to gain entry to the auto rack car interior when only the lower door lock assembly is in locked position;

an auxiliary locking mechanism for selectively preventing opening of said upper door lock assembly, said auxiliary locking mechanism being movable between a locked position and an unlocked position and said auxiliary locking mechanism preventing said upper door lock assembly from moving to said unlocked position when said locking mechanism is in said locked position; and manually operable means disposed near the lower end of said door to enable said auxiliary locking mechanism to be locked into said locked position and released for movement from locked position to unlocked position.

* * * * *

UNITED STATES PATENT AND TRADEMARK OFFICE

CERTIFICATE OF CORRECTION

PATENT NO. : 5,829,360

DATED : Nov. 3,1998

INVENTOR(S) : Micheal J. Rench, et al.

It is certified that error appears in the above-identified patent and that said Letters Patent is hereby corrected as shown below:

Column 8, line 9; after "position" (first occurrence), insert --and--.

Signed and Sealed this

Third Day of August, 1999

*Attest:*

*Attesting Officer*

Q. TODD DICKINSON

*Acting Commissioner of Patents and Trademarks*